United States Patent [19]

Belter

[11] Patent Number: 4,964,367

[45] Date of Patent: Oct. 23, 1990

[54] ADHESIVE APPLYING MACHINE

[75] Inventor: Robert F. Belter, Akron, Ohio

[73] Assignee: R.F. Belter Corporation, Akron, Ohio

[21] Appl. No.: 393,588

[22] Filed: Aug. 14, 1989

[51] Int. Cl.[5] ..... B05C 1/04

[52] U.S. Cl. ..... 118/667; 118/688; 118/712; 118/58; 118/248; 118/258

[58] Field of Search ..... 118/244, 258, 666, 667, 118/672, 206, 712, 713, 207, 202, 248, 249, 680, 688, 58; 427/428, 211

[56] References Cited

U.S. PATENT DOCUMENTS

| | | | |
|---|---|---|---|
| 3,215,558 | 11/1965 | Dascher | 427/428 |
| 3,326,708 | 6/1967 | Hawkins | 427/428 |
| 3,752,114 | 8/1973 | Knight | 118/666 |
| 3,784,657 | 1/1974 | Hutchinson et al. | 264/40.6 |
| 3,911,179 | 10/1975 | Goettsch | 118/667 |
| 4,486,149 | 12/1984 | Merkel | 417/32 |
| 4,598,842 | 7/1986 | Sticher et al. | 222/54 |

*Primary Examiner*—Willard Hoag

*Attorney, Agent, or Firm*—Renner, Kenner, Greive, Bobak, Taylor & Weber

[57] ABSTRACT

A machine for applying adhesive wax is provided with a pan for receiving the wax and a pair of rollers defining a bite therebetween through which sheet material may be passed. A lower one of the rollers passes through the adhesive both and transfers adhesive to the back of the sheet material. A heating element, connected to a thermostat, maintains the adhesive bath at a desired temperature. A motor, provided for rotating the rollers is interconnected with the heating elements such that actuation of the motor is inhibited absent actuation of the heating element. Additionally, a thermostatic switch may be interposed in the adhesive bath to prevent actuation of the motor unless the bath has reached a predetermined temperature.

13 Claims, 1 Drawing Sheet

ADHESIVE APPLYING MACHINE

TECHNICAL FIELD

The invention herein resides in the art of devices for applying a melted adhesive wax to a surface of a sheet of material to be adhered to another surface. Particularly, the invention relates to improvements in such devices.

BACKGROUND ART

Adhesive applying machines have been known for many years. The devices of interest are used for applying a thin layer or film of adhesive on the back of a sheet material such as a photograph, illustration, or the like, for adherence to a larger sheet. Typically, such devices are employed to facilitate the "lay-out" or editing of printed publications and similar materials. The most prominent unit of this nature in use today is that taught by U.S. Pat. No. 3,752,114 for ADHESIVE APPLYING MACHINE, assigned to the assignee of the instant application.

While extremely successful in the market due to its utility, the prior art adhesive wax applying machines have a number of associated shortcomings. Specifically, the prior art devices do not include a positive on/off switch to control the heating element, but a rheostat switch which includes no readily observable indicia that the heating element is on or off. Further, the prior art adhesive applying machines include a motor for controlling the drive of a pair of rollers for applying the adhesive, but the control of the motor is independent of the heater. Accordingly, the motor can be actuated without the adhesive wax being melted, the result being an overload to the motor. Further, if the wax is not sufficiently heated, or heated to a state of pure liquid, globules of adhesive can attach to the roller and to the article to which the adhesive is to be applied. As a result, lumps or the like are present on the sheet material to which the adhesive is applied. Worse yet, the globules may pass from the adhesive applying roller to the pressure roller, the result being the transfer of adhesive from the pressure roller to the face surface of the sheet to which the adhesive is to be applied. The prior art provides no means for assuring that operation of the machine can only occur after the wax has achieved a preferred temperature level to prevent such globules, assure the transfer of a uniform layer of adhesive, and reduce wear on the motor and drive mechanism.

Further, the motor control switch of the prior art does not include any visual indicia of the state of actuation of the switch, the motor often times inadvertently being left in a running condition.

The prior is was further devoid of a plurality of thermal fuses or thermal cutoffs to shut down the system if the wax or wax pan were to overheat. While the prior art has taught the implementation of a single thermal fuse for such purposes, no redundancy for such failures has been provided.

Additionally, the prior art teaches that the interconnection between the motor and drive roller could be achieved by a simple O ring. However, such O ring is given to slippage and wear, requiring frequent replacement and often being ineffective for properly driving the roller to effectuate a desired bite between the pressure roller and adhesive roller.

DISCLOSURE OF INVENTION

In light of the forgoing, it is a first aspect of the invention to provide an adhesive applying machine in which the heating element is controlled by a positive on/off switch which includes indicia of the state of actuation thereof.

Another aspect of the invention is the provision of an adhesive applying machine in which the motor control for driving the rollers is interconnected with the heater switch such that the motor cannot be actuated unless the heater is turned on.

A further aspect of the invention is the provision of an adhesive applying machine in which the roller drive motor is thermostatically controlled, incapable of operation until the adhesive wax has reached a preset temperature.

Yet an additional aspect of the invention is the provision of an adhesive applying machine in which a plurality of thermal fuses are provided for interrupting power to the motor and heater in the case of an overheat situation.

Yet a further aspect of the invention is the provision of an adhesive applying machine in which the drive between the motor and rollers is a positive drive, not given to slippage or wear.

A further aspect of the invention is the provision of an adhesive applying machine in which the motor control switch includes indicia of the state of actuation of the switch.

The foregoing and other aspect of the invention which will become apparent as the detailed description proceeds are achieved by an adhesive applying machine, comprising; a pan for receiving adhesive wax therein; a roller rotatable within said pan; drive means connected to said roller for selectively rotating said roller about an axis; and heating means connected to said pan for heating wax received within said pan, said heating means selectively inhibiting operation of said drive means.

Yet additional aspects of the invention are obtained by the improvement in an adhesive applying device having a pan for maintaining a bath of adhesive wax, a roller driven by a motor and rotatable within said bath, and a heater connected to the pan for rendering the heated adhesive wax fluid, such improvement comprising: a first switch interconnected with the heater; and a second switch interconnected with the motor, said first switch being interposed between said second switch and a power source.

BRIEF DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
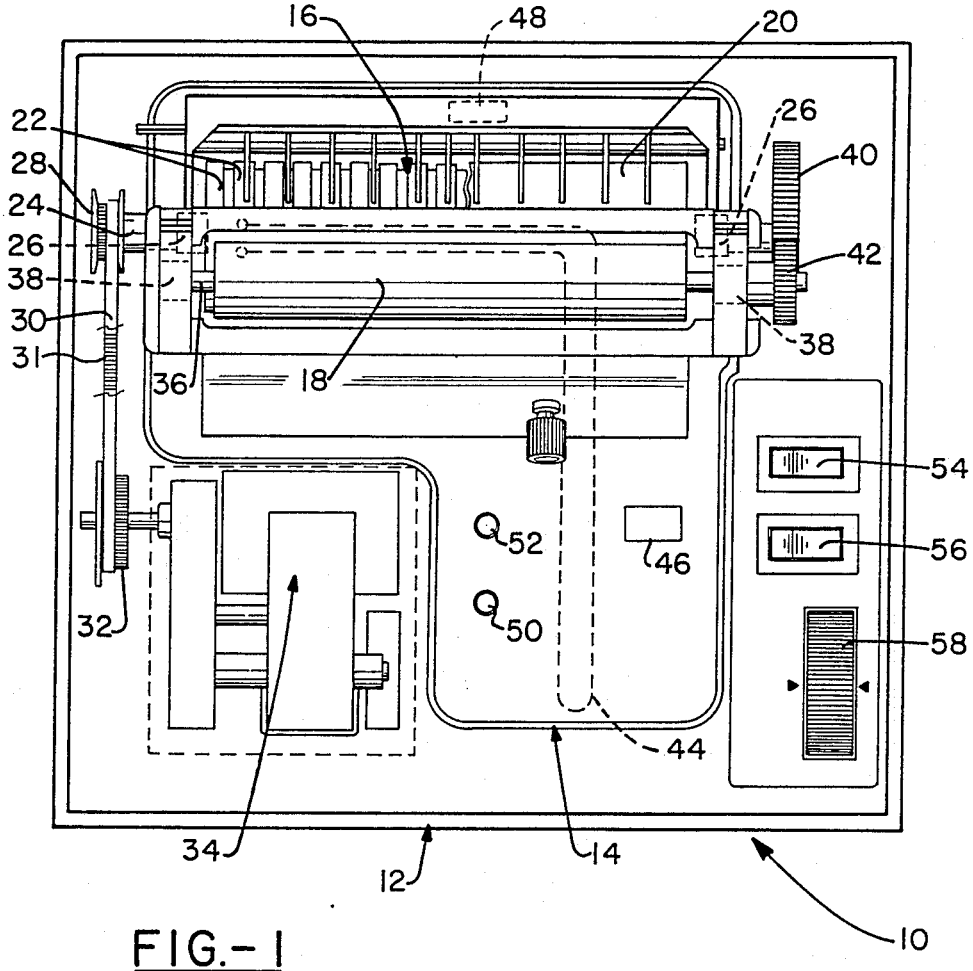
FIG. 1 is a top plan view of an adhesive applying machine according to the invention.

Referring now to the drawing and more particularly FIG. 1, it can be seen that an adhesive applying machine according to the invention is designated generally by the numeral 10. A housing 12 of plastic or other suitable material is provided to receive and maintain the operative structure of the invention. A pan or tray 14 is provided for receiving an adhesive wax, such being well known to those skilled in the art to be solid at room temperature and liquid at an elevated temperature. In a preferred embodiment of the invention, the pan or tray 14 is of aluminum construction or other suitable material evidencing high thermal conductivity.

A lower roller 16 is partially received in the pan 14 such that a lower portion of the roller 16 is maintained within a bath of the adhesive wax. A top roller 18 is maintained above and slightly forward of the center of the roller 16. As will be appreciated by those skilled in the art, the top roller 18 constitutes a pressure roller while the lower roller 16 constitutes an adhesive bath roller. A bite is created between the rollers 16, 18 with a slight clearance therebetween such that sheet materials to be coated with adhesive may be received in the clearance of the bite. The clearance is provided to assure that adhesive is not transferred from the roller 16 to the roller 18, such that no adhesive is imparted to the top or face surface of the sheet material to be adhesively coated.

As is shown, the roller 16 may either be solid as indicated at a portion 20, or striped by ribs as indicated at a portion 22. Typically, the entire roller 16 will either be solid or striped, the combination in a single roller in the drawing being presented for illustrative purposes only. In either event, as the roller 16 is caused to rotate within the heated bath of liquid adhesive wax, a sheet of material positioned in the bite between the rollers 16, 18 is fed therebetween with the bottom surface thereof being coated with the adhesive wax carried by the roller 16. In the case of the roller having the ribs thereon such as at 22, the adhesive is imparted to the material in lineal zones. When a solid roller such as at 20 is used, the entire back surface of the material is coated with adhesive. It should further be understood by those skilled in the art that a doctor blade or the like (not shown) is maintained in close juxtaposition to the roller 16 to meter a film of uniform thickness onto the roller. In a preferred embodiment of the invention, a first end of the doctor blade is maintained within the bath of adhesive wax and is heated thereby, the opposite end being above the bath and in close spaced apart relationship with the roller 16.

As shown, the roller 16 has a shaft 24 extending axially therethrough, the same being supported by bearings or support blocks 26. A pulley 28 is attached to one end of the shaft 24. A belt 30 interconnects the pulley 28 with a drive pulley 32 connected to and driven by the motor 34. As shown, the pulleys 28, 32 are characterized by a plurality of teeth circumferentially spaced thereabout, the same being adapted for mating engagement with corresponding teeth 31 shown in the cutaway portion of the belt 30. Effectively, a timing belt is thus used to achieve drive from the motor 34 to the roller 16, such drive substantially eliminating slippage, providing for longer belt life, and more positive coating action as sheet material is moved through the bite between the rollers 16, 18.

It will further be seen that a shaft 36 is connected to and extends axially from the roller 18. The shaft 36 is received by suitable bearings or support blocks 38 at each end thereof. A drive gear 40 maintained at an end of the shaft 24 of the roller 16 mates with a driven gear 42 maintained upon the shaft 36 of the roller 18. Accordingly, the rollers 16 and 18 rotate in unison as the roller 16 is driven by the motor 34. Accordingly, sheet material inserted into the bite between the two rollers is readily transported across the bath roller 16 under urging of the pressure roller 18.

Maintained within a tube or the like, formed within the bottom of the pan 14 is an elongated electrical heating element 44. Such heating element, well known to those skilled in the art, may be centrally positioned within the bottom of the pan, the thermal conductivity of the pan dissipating the heat throughout. Further, the wax maintained within the pan, upon becoming liquified, aids in the integration of the heat across the pan and throughout the bath. Also maintained, at several points in the bottom of the pan 14, are a plurality of thermal cut-offs or thermal fuses 46, 48. As will be discussed later herein, the thermal fuses 46, 48 are employed to disable the heater 44 and motor 34 in the event that the pan 14 has overheated. The provision of two such thermal cutoffs provides a safety factor redundancy.

Also maintained by the pan 14 are thermal sensors 50, 52 which are operative to sense the temperature of the wax within the bath of the pan 14. These thermal sensors are interconnected with thermostat switches to be discussed later herein.

A switch 54 of the on/off positive action type is operatively connected to the motor 34 for actuation thereof. In like manner, an on-off positive action switch 56 is interconnected with the heater 44. Finally, an adjustable thermostat 58 is provided to allow an operator to set a selected temperature for the wax in the bath and thus control the application of the power to the heater 44 in a method to be discussed below.

Figure 2:
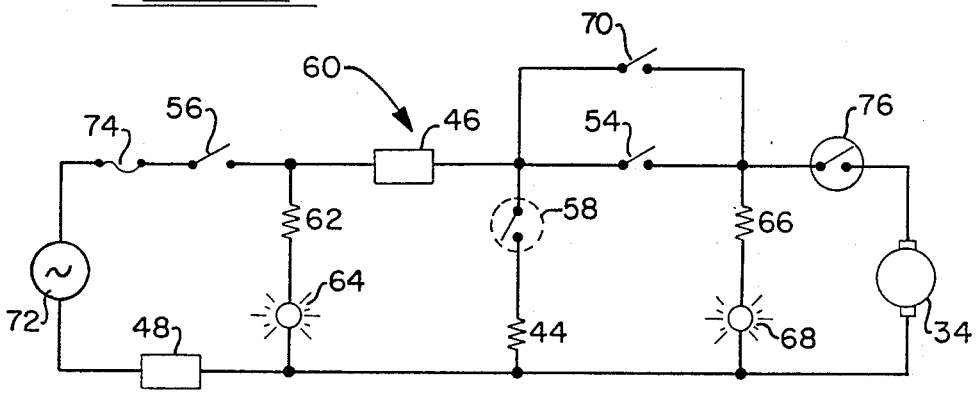
FIG. 2 is a schematic of the control circuit of the invention.

With reference now to FIG. 2, the control circuitry of the invention can be seen as designated generally by the numeral 60. As shown, the heater switch 56 has associated therewith a resistor 62 and neon lamp 64 such that the switch, when closed, will cause the associated lamp 64 to illuminate, indicating that the heater has been actuated. In like manner, the switch 54 of the motor 34 has associated therewith a resistor 66 and neon lamp 68 which is illuminated when the switch 54 is closed, to indicate the state of actuation thereof. A foot switch 70, preferably of the momentary type, is provided in parallel or shunt with the switch 54, such that actuation of the motor 34 may be achieved either by hand or foot operation.

Finally, it will be seen that an AC power source 72 is provided for interconnection with the circuit 60 for application of voltage and current thereto. An appropriate fuse 74 is provided to terminate the application of such power in the event of a short or overload. Finally, a thermostatic switch 76 is interposed between the motor 34 and its associated switches 54, 70 to inhibit operation of the motor 34 until the wax in the bath has achieved its desired level, such being indicative of a fluid state of the adhesive wax. To that end, the thermostatic switch 76 is interconnected with the thermal sensor 52 for monitoring the wax temperature level. By prohibiting operation of the motor 34 until the wax has achieved a temperature at which it is assured that the wax is in a totally liquid state, it is assured that no chunks of adhesive will be passed by the rollers 16, 18 and that the doctor bar can meter an appropriate thickness of the adhesive over the entire surface of the roller 16. In a preferred embodiment of the invention, the thermostat 76 has an associated hysteresis characteristic such that the thermostatic switch 76 will close at a first higher temperature and open at a second lower temperature to accommodate fluctuations of the temperature of the wax as controlled by the adjustable thermostat 58 associated with the thermal sensor 50.

In use, an operator first closes switch 56 to apply current to the heater 44 to heat the pan 14 and melt the adhesive wax and create a liquid bath therein. Upon closure, current passes from the source 72 through the fuse 74, switch 56, resistor 62 and lamp 64, indicating that the switch has been closed and that current is passing to the heater 44. The thermostatic switch 58, in series connection with the heating element 44, is operative to make or break interconnection of the heating element 44 with the power source 72 dependent on the temperature of the wax as monitored by the thermal sensor 50. When the wax temperature is below that selected by the thermostat 58, the switch of the thermostat closes and current passes to the heater 44. When the wax reaches the desired temperature as set by the adjustable thermostat switch 58, the switch opens and the passage of current to the heater 44 is inhibited. Accordingly, the switch 58 opens and closes to keep the temperature of the wax at the selected temperature.

It will be appreciated that switches 54, 70, which control actuation of the motor 34, can only pass current to the motor 34 when the switch 56 for the heater 44 is closed. This prevents actuation of the motor 34 unless the heater 44 has been actuated. Further protection may be provided to the motor 34 by employing the thermostatic switch 76 discussed above. With the characteristic temperature of the thermostat 76 set at a level which assures that the adhesive wax is in a fluid state, the motor 34 can only cause the rollers 16, 18 to rotate once the wax has been melted into a liquid. This not only prevents wear and abuse on the motor 34, but also on the drive belt 30. Further, it is assured that a smooth uniform layer of adhesive is applied to the roller 16 by the associated doctor bar and that no globules of adhesive are transferred. Accordingly, the top pressure roller 18 is kept clean of adhesive such that none is passed to the face surfaces of the sheet material employed.

It should, of course, be recognized that the resistor 66 and neon lamp 68 are provided in association with the switch 54 to provide a visual indicia that the motor switch has been closed and that power is available thereto.

As is further shown, a pair of thermal fuses 46, 48 are interposed within the circuit 60 to open the circuit and render the heater 44 and motor 34 inoperative in the case of an overheating situation. This obviously allows the wax and pan 14 to cool down and prevents an otherwise dangerous situation.

It should be appreciated that with the structure just discussed, the thermostat 58 may be adjusted to a low temperature level for periods of nonuse, but sufficient to allow the adhesive wax to be in such a state that it can quickly be heated up to operating conditions. When left in this state, below the temperature sufficient to obtain proper metering onto the roller 16, the thermostat switch 76 is open and operation of the motor is inhibited. When desired for use, the thermostat 58 may be adjusted upwardly such that, upon reaching the characteristic temperature of the thermostat 76, the motor 34 may be caused to rotate and the system may be used for imparting adhesive to the back of a piece of sheet material.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breath of the invention reference should be made to the following claims.

What is claimed is:

1. An adhesive applying machine, comprising;

a pan for receiving adhesive wax therein;

a roller rotatable within said pan;

drive means connected to said roller for selectively rotating said roller about an axis;

heating means connected to said pan for heating wax received within said pan, said heating means selectively inhibiting operation of said drive means;

a plurality of thermal fuses interposed within said pan and interconnected between a power source and said drive means and heating means; and wherein said heating means comprises a first switch interconnected with a heating element received by said pan and a first thermostatic switch interposed between said heating element and said pan for maintaining adhesive wax within said pan at a set temperature, and said drive means comprises a second switch interconnected with a motor connected to said roller, said first and second switches being in series connection with the power source.

2. The adhesive applying machine according to claim 1, wherein said first thermostatic switch is manually adjustable to establish said set temperature.

3. The adhesive applying machine according to claim 2, wherein said first and second switches further comprises respective lamps associated with said switches, said lamps being illuminated by closure of said respective switch.

4. The adhesive applying machine according to claim 2, further comprising a third switch in shunt with said second switch.

5. The adhesive applying machine according to claim 2, further comprising a second thermostatic switch interconnected between said second switch and said motor, said second thermostatic switch inhibiting operation of said motor when the temperature of wax within said pan is below a particular level.

6. The adhesive applying machine according to claim 5, wherein said second thermostatic switch has a characteristic first temperature and a characteristic second temperature, said first temperature being greater than said second temperature, said thermostatic switch closing at said first temperature and opening at said second temperature.

7. An adhesive applying machine, comprising;

a pan for receiving adhesive wax therein;

a roller rotatable within said pan;

drive means connected to said roller for selectively rotating said roller about an axis;

drive means connected to said pan for heating wax received within said pan, said heating means selectively inhibiting operation of said drive means;

wherein said heating means comprises a first switch interconnected with a heating element received by said pan and a first thermostatic switch interposed between said heating element and said pan for maintaining adhesive wax within said pan at a set temperature, and said drive means comprises a second switch interconnected with a motor connected to said roller, said first and second switches being in series connection with the power source; and a third switch in shunt with said second switch.

8. The adhesive applying machine according to claim 7, wherein said third switch comprises a momentary foot pedal switch.

9. In an adhesive applying devise having a pan for maintaining a bath of adhesive wax, a roller driven by a motor and rotatable within said bath, and a heater connected to the pan for rendering the adhesive wax fluid, the improvements, comprising:

a first manually actuatable switch interconnected with the heater; and a second manually actuatable switch interconnected with the motor, said first switch being interposed between said second switch and a power source;

a variable thermostat interconnected between the heater and said first switch for selecting a temperature at which the adhesive wax bath is maintained; and a manually actuated foot switch in shunt with said second switch.

10. The improvement according to claim 9, further comprising a thermally responsive switch interposed between the motor and said power source, preventing application of power to the motor until the temperature of the wax bath reaches a predetermined level.

11. The improvement according to claim 9, wherein said first and second switches have associated indicia of the states of actuation of said switches.

12. An adhesive applying machine, comprising;

a pan for receiving adhesive wax therein;

a roller rotatable within said pan;

drive means connected to said roller for selectively rotating said roller about an axis;

heating means connected to said pan for heating wax received within said pan, said heating means selectively inhibiting operation of said drive means;

wherein said heating means comprises a first switch interconnected with a heating element received by said pan and a first thermostatic switch interposed between said heating element and said pan for maintaining adhesive wax within said pan at a set temperature, and said drive means comprises a second switch interconnected with a motor connected to said roller, said first and second switches being in series connection with the power source; and a timing belt interconnecting said motor and said roller, said timing belt having teeth thereon mating with teeth on pulleys on each of said motor and roller.

13. In an adhesive applying device having a pan for maintaining a bath of adhesive wax, a roller driven by a motor and rotatable within said bath, and a heater connected to the pan for rendering the adhesive was fluid, the improvement, comprising:

a first manually actuatable switch interconnected with the heater;

a second manually actuatable switch interconnected with the motor, said first switch being interposed between said second switch and a power source;

a variable thermostat interconnected between the heater and said first switch for selecting a temperature at which the adhesive wax bath is maintained; and a plurality of thermal fuses maintained by said pan and interposed between said power source and the motor and heater for interrupting power to said motor and heater when the temperature of the pan exceeds a particular level.

* * * * *